United States Patent [19]

Nagasaki et al.

[11] 3,979,108

[45] Sept. 7, 1976

[54] METHOD AND APPARATUS FOR REMOVING SLAG

[75] Inventors: Katsumi Nagasaki, Sakai; Yoshito Seto, Yamato-Koriyama; Hiroyuki Yamasaki, Amagasaki, all of Japan

[73] Assignee: Kubota, Ltd., Osaka, Japan

[22] Filed: Jan. 15, 1975

[21] Appl. No.: 541,139

[30] Foreign Application Priority Data

Jan. 17, 1974 Japan ..... 49-89171

[52] U.S. Cl. ..... 266/201; 266/227; 75/24

[51] Int. Cl.[2] ..... C21C 7/00

[58] Field of Search ..... 266/34 R, 34 PT, 34 V, 266/37, 38; 75/24, 49

[56] References Cited

UNITED STATES PATENTS 3,867,132 2/1975 Perry ..... 75/49

FOREIGN PATENTS OR APPLICATIONS 263,640 9/1970 U.S.S.R. ..... 266/37

*Primary Examiner*—Gerald A. Dost

[57] ABSTRACT

Slag on the surface of a molten metal is drawn into the inlet end of a suction pipe which is provided with a water cooling jacket having orifices permitting the flow of water to the inlet end of the pipe for pelletizing the entering slag. The suction pipe is connected to a separator hopper, which is evacuated by an exhaust pump to create the suction, and which includes a slag discharge port closed by an openable valve. A sealed auxiliary hopper receives slag from the discharge port of the separator hopper when the valve thereof is opened, and also includes a slag discharge port closed by an openable valve. The hopper discharge valves are operated alternately by suitable control means so that when one valve is open the other is closed, thereby enabling slag to be continuously sucked, separated, and intermittently discharged from the auxiliary hopper.

17 Claims, 18 Drawing Figures

METHOD AND APPARATUS FOR REMOVING SLAG

The present invention relates to a method and an apparatus for removing slag on molten metal by suction.

Heretofore, there have been developed various methods of removing slag in Heroult electric furnaces, slag in ladles used in making steel, slag in low frequency induction furnaces and reverberatory furnaces, slag in ladles for cupolas, slag produced in making rimmed steel and slag produced in melting metals. Examples of these methods include a blow system in which slag is blown off; an adsorption system using a chain, wire, plate or the like to which slag is caused to stick; and a mechanical method in which slag is ladled out or drained off. However, all of them are inefficient and in particular, mechanical methods have many disadvantages including thermal deformation.

The present invention provides a method and an apparatus for removing slag on the basis of a suction system wherein the inlet end portion of a suction pipe is prevented from being damaged by the heat of radiation from the molten metal or by the heat from the high temperature slag, and the sucked slag can be formed into pellets which are suitable for transport and separation within the suction pipe.

Thus, a method according to the invention comprises setting the suction port of a suction pipe at a predetermined level above slag to suck the latter, allowing water to flow from around said suction port against the sucked slag to pelletize said slag, and introducing the resulting pellets into separating means to separate the slag from the mixture of vapor, air, water and slag drawn through the suction pipe.

In sucking up slag, a system using an ejector may be conceived, but such ejector system can hardly be put into practice since its ability to suck up slag is insufficient. The present invention employs a suction system using a vacuum pump or a rotary blower and also provides a method which enables slag to be continuously sucked and separated.

More particularly, the invention uses as said separating means a separator hopper and an auxiliary hopper having an openable and closable discharge port adapted to be opened only when a similar port of said separator hopper has been closed. Said separator hopper is evacuated to suck slag into said separator hopper; the slag collected in the separator hopper is transferred to the auxiliary hopper by opening the discharge port of the separator hopper, during which the airtightness in the separator hopper is maintained by said auxiliary hopper; and the slag in the auxiliary hopper is taken out when the discharge port of the separator hopper has been closed, so that the separated slag can be intermittently taken out from the separating means while continuously effecting the suction of slag.

In embodying the method of the invention described above, it is preferable to use a suction head for slag removal comprising a suction pipe, a water cooling jacket defined at least around the outer periphery of the inlet end or suction port of said suction pipe, and a plurality of circumferentially spaced orifices through which the water in the jacket flows into said suction port. With such a suction head, at least the inlet end portion of the suction pipe can be positively cooled by the water in the water cooling jacket while the water in the jacket can be utilized for the quick cooling and pelletization of sucked slag.

Further, according to a preferred embodiment of the invention, said suction port is formed by a suction mouthpiece removably mounted on the suction pipe. This arrangement is economical in that the inlet end portion of the suction pipe, which is most likely to be affected by heat, can be replaced depending upon its condition. Moreover, the inspection and maintenance of the suction port are easy and by preparing suction mouthpieces different in their cross-sectional shape and in the size of their suction port, and by selectively using them, it is possible to change the suction conditions of slag depending upon the circumstances.

In the case of an arrangement wherein orifices are formed in the peripheral wall of an inner pipe constituting said jacket and water is allowed to flow out through said orifices obliquely downwardly toward the slag suction port, such orifices have to be bored in the inner pipe of the jacket at an angle (about 60°), so that the machining and maintenance are difficult and the sucked slag tends to clog in the orifices. There is another disadvantage in that the location where the sucked slag and the water which is flowing out through said orifices are mixed together becomes farther from the surface of molten metal (that is, the distance from the end surface of the suction mouthpiece to the water mixing location becomes longer.) Thus, as the location of mixing with water is nearer to the inlet end of the slag suction mouthpiece, the cooling and pelletization become faster and more reliable, preventing overheating of the slag suction mouthpiece and ensuring that the suction force will act on the pellets of slag more positively to improve the slag suction effect.

According to another preferred embodiment of the present invention, the aforesaid problems are taken into consideration by using a suction head constructed in such a manner that said orifices are formed in the lower end periphery of said water cooling jacket so as to be downwardly directed and said suction mouthpiece is provided with a surface whereby water flowing out through said orifices is deflected to the center of the suction port.

With such a suction head, not only are the machining, inspection and maintenance of the orifices very easy, but also the suction mouthpiece is forcibly cooled to improve its durability and the location where water flowing out through the orifices and slag being sucked are mixed together can be brought sufficiently close to the open end of the suction port, thus avoiding all possibilities of the orifices getting clogged.

Other numerous features and merits of the present invention will be readily understood from preferred embodiments thereof to be described with reference to the accompanying drawings.

DESCRIPTION OF THE PREFERRED EMBODIMENTS

Figure 1:
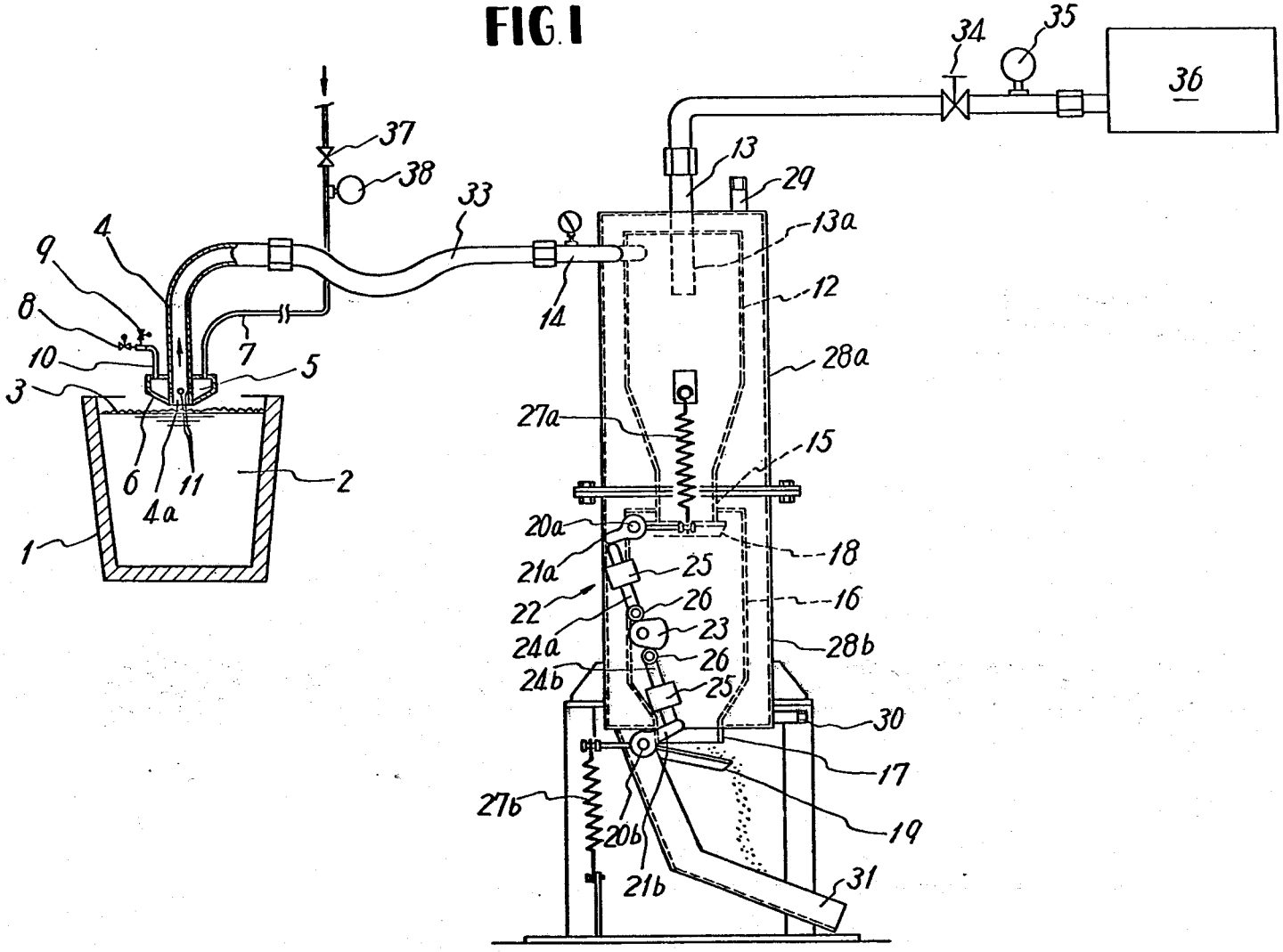
FIG. 1 is an elevational view, partly broken away, showing the basic embodiment of the present invention.

In FIG. 1, the character 1 designates a ladle; 2, molten metal; and 3 designates slag. A slag suction pipe 4 has an enclosure 6 secured around the periphery of its inlet end or suction port to define a jacket 5. Connected to the jacket 5 are a water supply pipe 7 and a drain pipe 10 having at the outlet end thereof an air-escape valve 8 and a safety valve 9. The inner wall of the jacket 5 is provided with a plurality of circumferentially spaced orifices 11 opening to the interior of the suction pipe 4.

A separator hopper 12 receives the inlet end 13*a* of an exhaust connector pipe 13 at the upper central region of the hopper. Tangentially connected to the peripheral wall of the hopper and disposed laterally of said inlet end 13*a* is an air suction connector pipe 14 to which said suction pipe 4 is connected.

Figure 2:
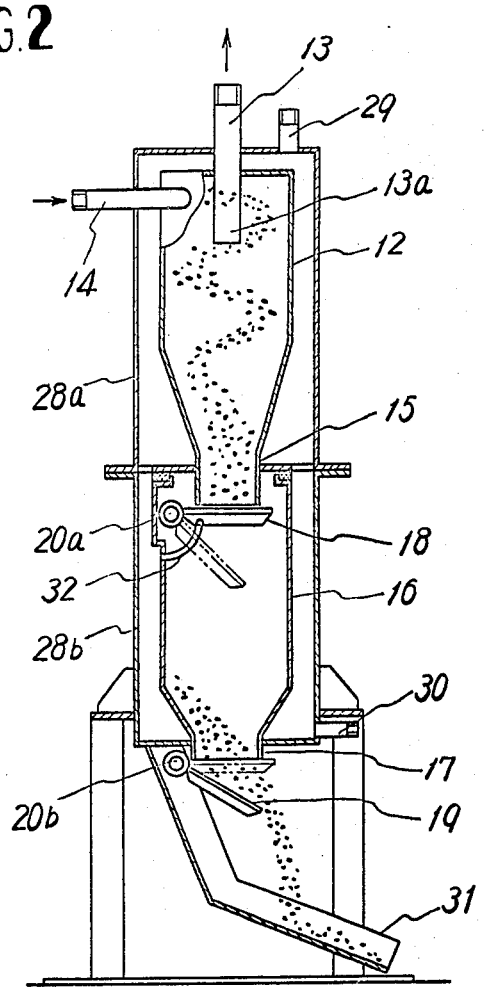
FIG. 2 is a sectional elevation of separating means used in the embodiment of FIG. 1.

The separator hopper 12 has a discharge port 15 at the lower end thereof to which the upper end of an auxiliary hopper 16 is connected. The discharge port 15 of the separator hopper and a discharge port 17 of the auxiliary hopper are provided with openable valves 18 and 19, respectively. These valves 18 and 19 are fixed on rotary shafts 20*a* and 20*b* supported for rotation laterally of the discharge ports 15 and 17, respectively, said rotary shafts 20*a* and 20*b* being operatively connected to an opening and closing mechanism 22 through rotary arms 21*a* and 21*b*. The mechanism 22 comprises a rotary cam 23 adapted to be rotated by a motor or the like, and connecting rods 24*a* and 24*b* installed for advance and retraction between the peripheral surface of the rotary cam 23 and said rotary arms 21*a* and 21*b*, respectively. The connecting rods 24*a* and 24*b* are arranged on both sides of the rotary cam 23 and are opposed to each other so that the rotation of the rotary cam 23 causes the valves 18 and 19 to be opened and closed alternately with each other or in a "seesaw" fashion. The character 25 designates support members for sliding movement of said connecting rods 24*a* or 24*b*; 26 designates a cam roller; and 27*a* and 27*b* designate springs for normally urging the valves 18 and 19 to their closed positions, respectively. Further, the separator hopper 12 and auxiliary hopper 16 are provided with water cooling jackets 28*a* and 28*b*, respectively, which, as shown in FIG. 2, communicate with each other, the upper end of said water cooling jacket 28*a* and the lower end of said water cooling jacket 28*b* being provided with a drain port 29 and a water supply port 30, respectively. The character 31 designates a slag discharging chute. Further, as shown in FIG. 2, the water cooling jacket 28*b* may be connected to the valve 18 by a flexible pipe 32 to cool the valve 18.

The manner in which the apparatus is used will now be described.

The suction pipe 4 is connected to the air suction connector pipe 14 of the separator hopper 12 through a flexible pipe 33, and the exhaust connector pipe 13 is connected to suction means 36 such as a vacuum pump or a blower through an on-off valve 34 and a pressure gage 35. In addition, the characters 37 and 38 designate an on-off valve and a pressure gage respectively, provided on said water supply pipe 7.

When the suction means 36 is operated, the interior of the inlet end or suction port 4*a* of the suction pipe 4 is evacuated through the separator hopper 12, so that by positioning said suction port 4*a* at a suitable level above the slag 3, the latter is sucked up into the suction pipe 4. Since water is supplied into the jacket 5 by the water supply pipe 7 and flows into the suction port 4*a* through the orifices 11, the slag 3 is quickly cooled and thereby pelletized and is transferred to the separator hopper 12 through the suction pipe 4 and flexible pipe 33. The pelletized slag is separated and accumulates on the valve 18 which has closed the discharge port 15.

The rotary cam 23 is rotated by any suitable means (not shown) either continuously or intermittently at regular intervals, whereby the valves 18 and 19 are selectively opened against the springs 27*a* and 27*b* through the intermediary of the connecting rods 24*a*, 24*b*, rotary arms 21*a*, 21*b* and rotary shafts 20*a*, 20*b*. Thus, when the valve 18 is opened, the slag collected in the separator hopper 12 falls down into the auxiliary hopper 16 whose discharge port 15 is now closed, and is temporarily stored. After the valve 18 is closed by the spring 27*a* to cover the discharge port 15 again, the valve 19 is opened against the spring 27*b*, whereupon the discharge port 17 of the auxiliary hopper 16 is opened so that the slag collected in the auxiliary hopper 17 is discharged onto the chute 31. By the fact that the valves 18 and 19 are selectively opened as described above, the separated slag can be intermittently and automatically discharged to the outside of the apparatus without involving the danger that the suction system extending from the suction port 4*a* to the suction means 36 is opened to atmosphere through the discharge ports 15 and 17 to have its negative pressure destroyed, thereby allowing the slag 3 to be continuously sucked and separated.

Since the separator hopper 12, auxiliary hopper 16 and its valve 18 are cooled by the cooling water flowing from the water supply port 30 through the jackets 28*b* and 28*a* and out through the drain port 29, even if the sucked and separated slag is at a high temperature, the separator hopper 12, auxiliary hopper 16, lids 18, 19 and mechanism 22 can be prevented from being damaged by the heat.

Figure 3:
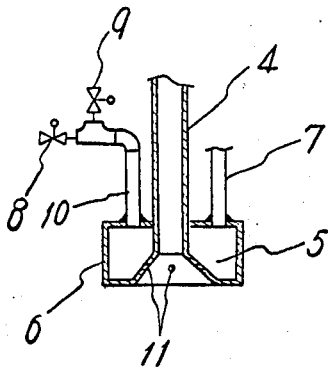
FIGS. 3 through 8 are sectional elevations showing other embodiments of the suction head.
Figure 4:
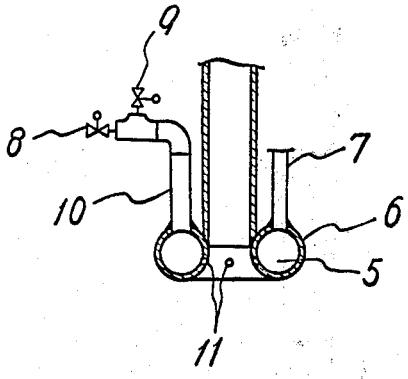

FIG. 3 shows a modification in which the suction port 4*a* is funnel-shaped and such funnel-shaped portion is provided with the orifices 11. FIG. 4 shows another modification in which the enclosure 6 of the jacket 5 is constituted by a torus-shaped pipe.

Another embodiment relating to a slag suction head shown in FIGS. 5 and 6 will now be described.

A suction head 41 has a water cooling jacket 43 for internally defining a slag suction passage 42, said jacket 43 being of a double pipe construction comprising inner and outer pipes 44 and 45, said outer pipe 45 carrying annular plates 46 and 47 at its upper and lower ends, respectively, interconnecting the inner and outer pipes to seal the space therebetween. Further, the jacket 43 is provided with an air escape valve 48 and a safety valve 50 and is adapted to be supplied with water through a water supply pipe connector 49. The inner pipe 44 of the water cooling jacket 43 is longer than the outer pipe 45 and extends well above the latter so that after the slag passing through the slag suction passage 42 is sufficiently sucked and accelerated, the slag is transferred to a to a separator hopper, such as the one shown in FIG. 1, through a bent pipe 52 removably connected to the inner pipe 44 by a socket 51. The lower end of the inner pipe 44 extends somewhat beyond the lower end of the outer pipe 45 to define a skirt portion 53 (FIG. 6). Secured to the annular plate 47 at the lower end of the jacket 43 is a sleeve 55 having an externally threaded portion 54. Inside the sleeve 55, the boundary plate 47 is formed with a plurality of circumferentially regularly spaced orifices 56 which are at right angles thereto. A slag suction mouthpiece 57 having an internally threaded portion 58 is threadedly fitted over said sleeve 55. The reference 59 designates an abutment surface provided on the slag suction mouthpiece 57 for abutting against the front end of the sleeve 55. When the abutment surface 59 abuts against the sleeve 55, there is defined a clearance 61 between the skirt portion 53 and an inner inclined annular surface 60 of the slag suction mouthpiece 57 so that as the water from the orifices 56 passes through said clearance 61, its direction of flow is corrected so that the water flows laterally toward the center of the suction port 62 of the mouthpiece 57.

The operation will now be described. With the suction head 41 positioned with its suction port 62 disposed immediately above the molten metal, water is supplied into the water-cooling jacket 43 through the water supply pipe connector 49 while air is drawn through the suction port 62 by a vacuum pump or the like, whereby the slag is sucked up through the suction port 62, slag suction passage 42 and bent pipe 52 and transferred to the separator tank. Concurrently therewith, the water in the jacket 43 flows against the inclined surface 60 of the mouthpiece 57 through the orifices 56 and as it passes through the clearance 61 its direction of flow is changed so that it flows along the inclined surface 60, flowing laterally toward the suction port 62 of the slag suction mouthpiece 57. Therefore, as soon as the slag is sucked through the suction port 62, it is quickly cooled and pelletized by the action of the water flowing from around the periphery. It follows that a location where the slag and water are mixed together is provided immediately before the slag enters the slag suction passage 42. In this case, the suction head itself is, of course, cooled by the water supplied to the jacket 43, and since the water from the orifices 56 flows directly against the inner wall surface of the mouthpiece 57, the latter is constantly cooled, thereby preventing the mouthpiece 57 from being overheated by the heat radiated and transmitted from the slag. Further, since the water flows transversely and laterally of the slag being sucked up, there is no danger of the slag clogging in the mouthpiece 57. The presence of the skirt portion 53 prevents the slag from clogging in the orifices 56. Since the water flows toward the suction port 62 of the slag suction mouthpiece 57, there is produced a silencing effect. That is, without the flow of water, there would be produced a very strong metallic jet sound.

Figure 7:
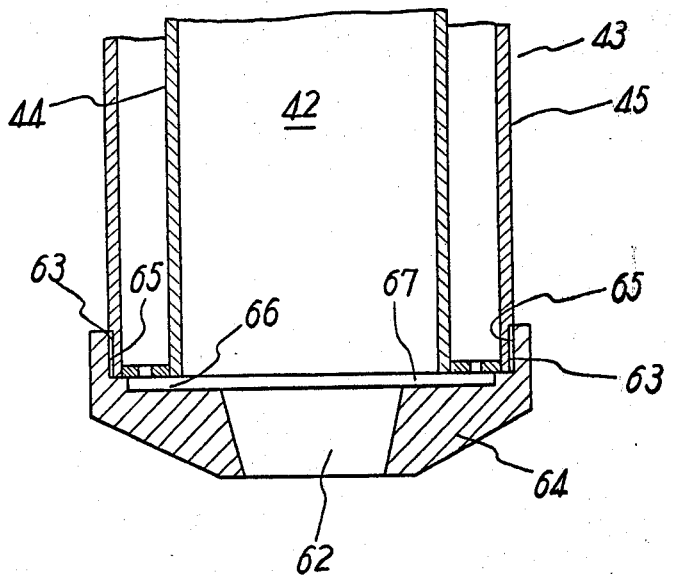
Figure 8:
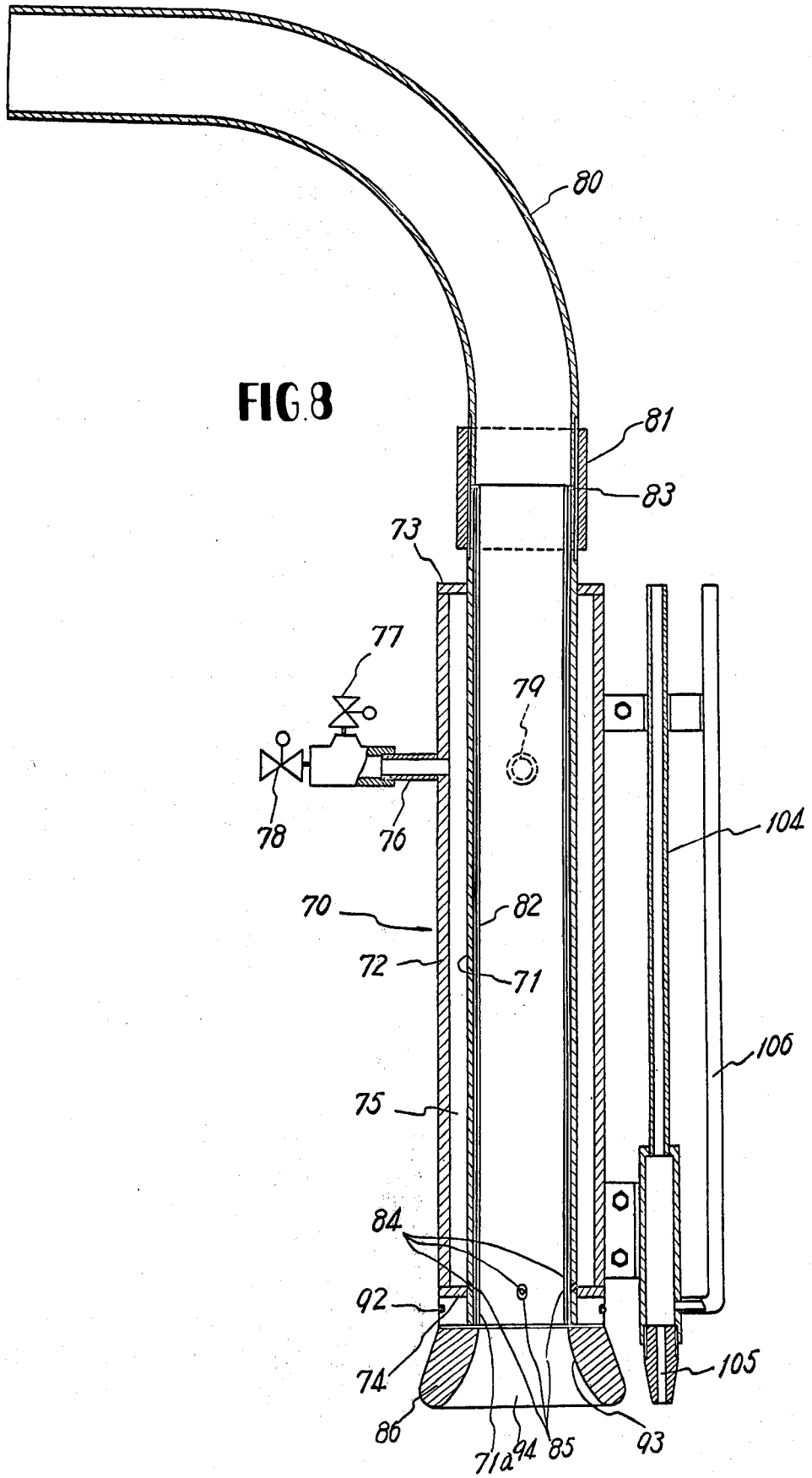
Figure 9:
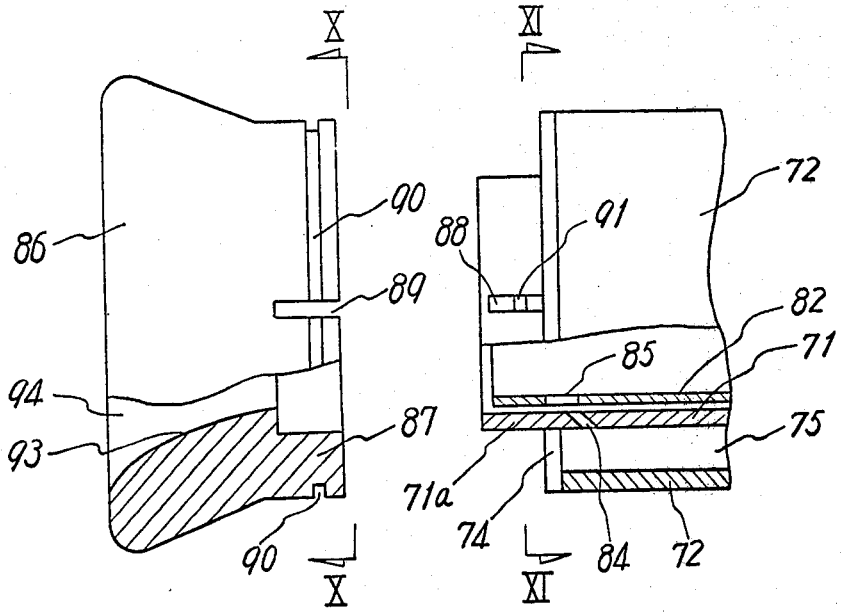
FIG. 9 is an exploded view, partly broken away, of the principal portions of the suction head shown in FIG. 8.
Figure 10:
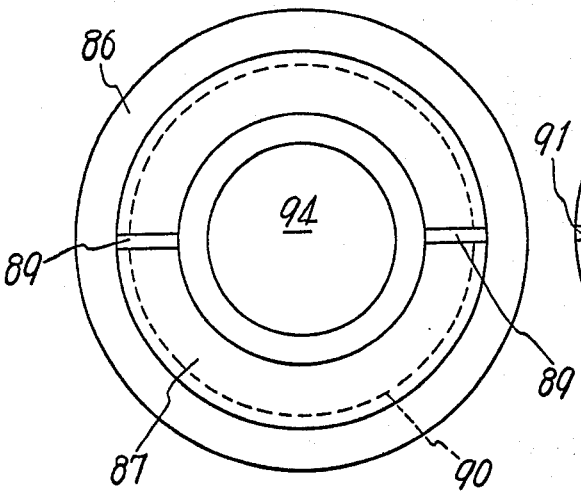
FIG. 10 is a view taken in the direction of arrows and along the line X—X in FIG. 9.
Figure 11:
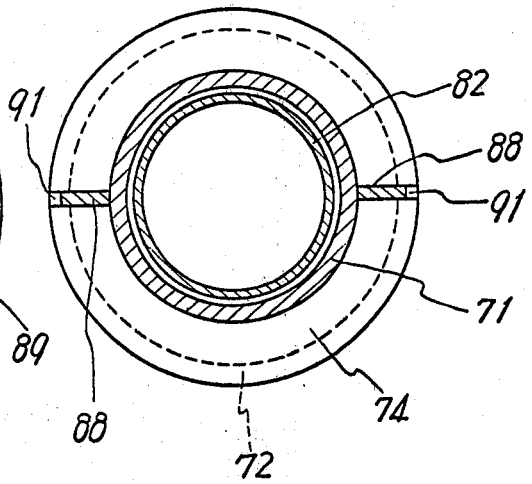
FIG. 11 is a section taken along the line XI–XI in FIG. 9.
Figure 12A:
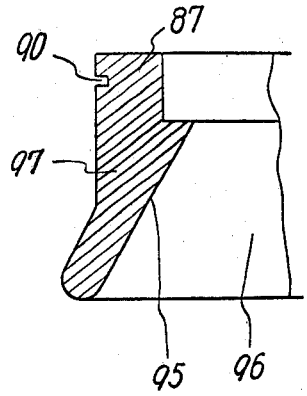
FIGS. 12A, 12B and 12C are sectional views showing the principal portions of other suction mouthpieces used in the suction head shown in FIG. 8.
Figure 12B:
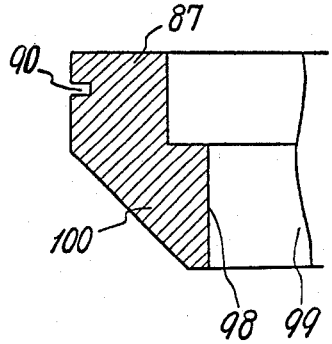
Figure 12C:
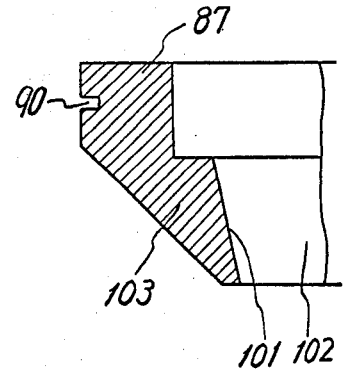

The skirt portion 53 and/or sleeve 55 may be omitted. In that case, as shown in FIG. 7, an externally threaded portion 63 may be provided on the outer periphery of the lower end of the outer pipe 45 of the jacket 43 so that a slag suction mouthpiece 64 having an internally threaded portion is directly mounted on the outer pipe 45. In the arrangement shown in FIG. 7, the inclined surface 60 is not provided and instead a flat recess 67 is formed in the mouthpiece 64 so that an annular water flow passage 66 extending at right angles to the direction of slag suction is defined between the lower end of the jacket 43 and the mouthpiece 64 when the latter is attached in position. Thus, the water from the orifices 56 is changed in its direction of flow through 90 degrees so that it flows against the slag being sucked up.

Figure 5:
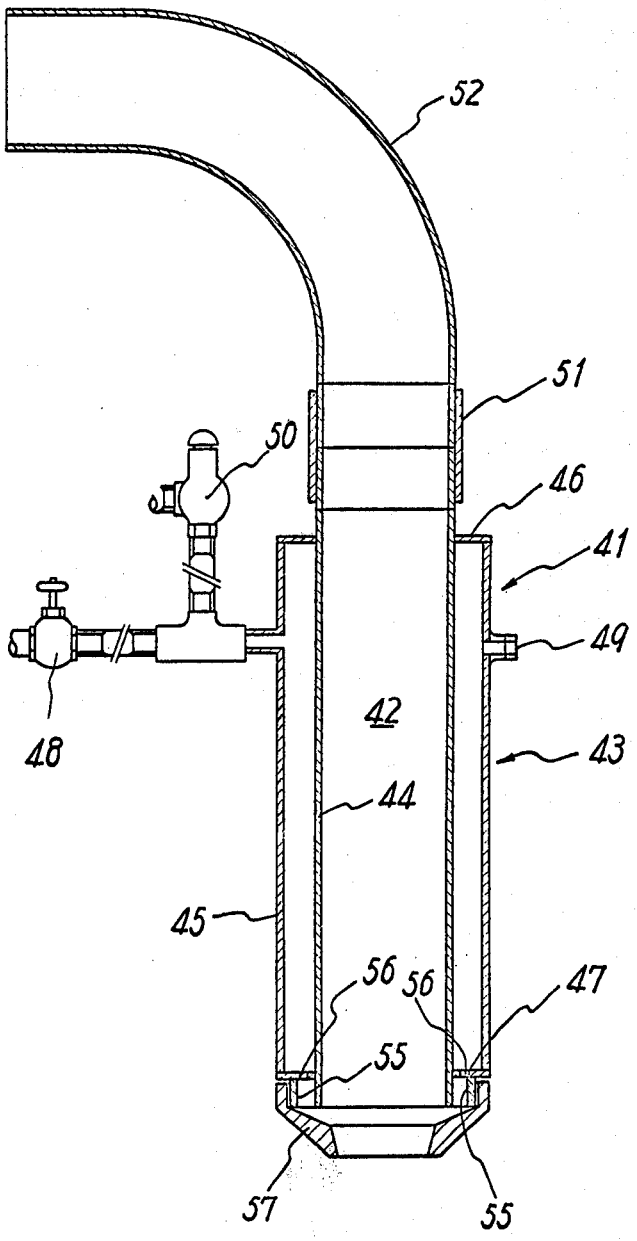
Figure 6:
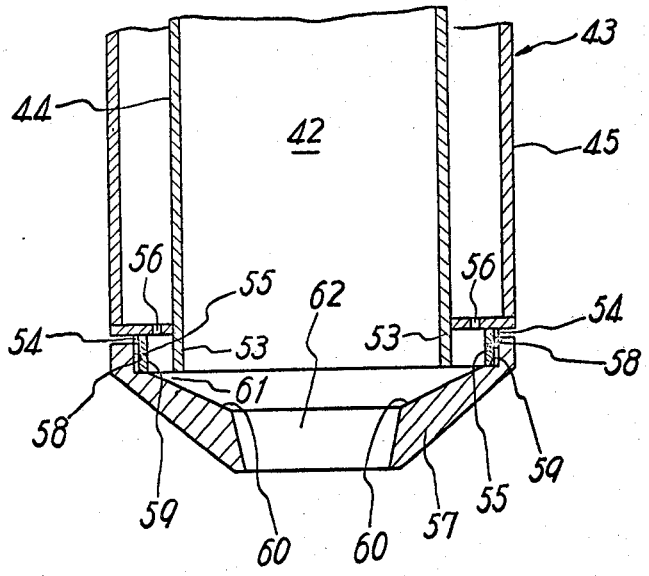

Now, referring to FIGS. 8 to 12, a suction head 70, like the suction head 41 shown in FIG. 5, is provided with a water cooling jacket 75 defined by an inner pipe 71, an outer pipe 72 and upper and lower annular plates 73 and 74. A safety valve 77 and an air escape valve 78 are connected to said water cooling jacket 75 through a branch pipe 76. Connected also to the jacket is a water supply pipe connector 79. A pipe bend 80 is removably connected to the upper end of the inner pipe 71 by a socket 81, but in connecting said pipe bend 80, the upper end flange 83 of a protective sleeve 82 inserted in the inner pipe 71 and extending along the entire length of the latter is clamped between the end surfaces of the pipe bend 80 and the inner pipe 71 so that the sleeve 82 is fixed at the same time. The sleeve 82 may be removed from the inner pipe 71 for replacement by a new one. The inner pipe 71 is provided with a plurality of circumferentially suitably spaced orifices 84 which are disposed adjacent the lower end of the water cooling jacket 75 and as much as possible toward the lower end of the inner pipe 71. Holes 85 aligned with said orifices 84 are formed in the sleeve 82.

A suction mouthpiece 86 has an engagement portion 87 (FIG. 9) adapted to be fitted over a sleeve portion 71*a* of the inner pipe 71 projecting from the lower annular plate 74. The engagement portion 87 is provided with two slots 89 adapted to receive two locking projections 88 fixed to said sleeve portion 71*a* and annular plate 74. The outer peripheral surface of the engagement portion 87 and the outer sides of the projections 88 are provided with grooves 90 and 91 in such a manner that these grooves form a single continuous annular groove when the engagement portion 87 is fitted over the projecting sleeve portion 71*a* with said slots 89 receiving the locking projections 88. Thus, the suction mouthpiece 86 is removably attached to the suction head 70 by a ring 92 (FIG. 8) removably fitted in the grooves 90 and 91.

The suction mouthpiece 86 has a suction port 94 defined by its inner surface 93 which is continuous with the inner surface of the sleeve 82, said inner surface 93 being curved and flaring. The sucking condition of slag may be optionallyi changed by replacing the suction mouthpiece 86 shown in FIG. 8 by a suction mouthpiece 97, shown in FIG. 12A, having a suction port 96 defined by an inner surface 95 in the form of a conical flare; by a suction mouthpiece 100 shown in FIG. 12B having a suction port 99 defined by an inner surface 98 in the form of a straight cylinder; by a suction mouthpiece 103 shown in FIG. 12C having a suction port 102 defined by an inner surface 101 in the form of an inverted cone (or in a converging form); or by any other suitable suction mouthpiece.

A static pressure tube 104 (FIG. 8) is provided at its lower end with an air injection nozzle 105 which opens in the same direction as the suction port 94 of the suction mouthpiece 86, and is arranged side by side with the suction head 70. One end of a detection tube 106, arranged side-by-side with the static pressure tube 104, is connected to the static pressure tube 104 adjacent the nozzle 105.

Figure 13:
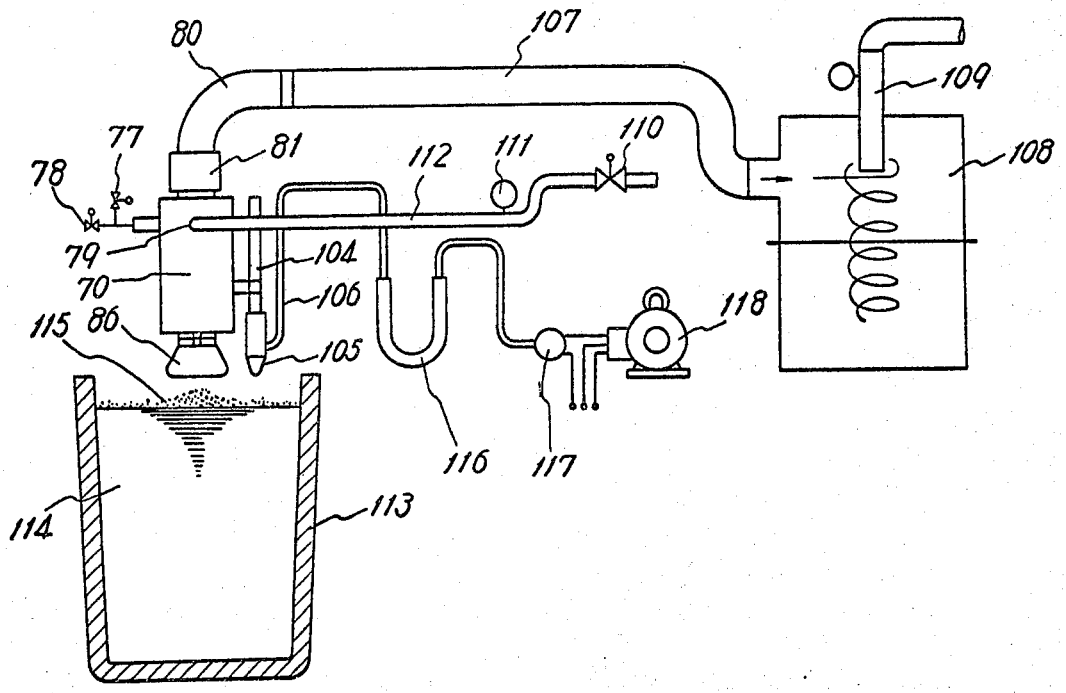
FIG. 13 is an elevational view, partly broken away, showing how the suction head shown in FIG. 8 is used.

The manner in which the suction head 70 constructed in the manner described above is used will now be described with reference to FIG. 13.

The pipe bend 80 is connected to a separator hopper 108 through a flexible pipe 107, said hopper having a suction pipe 109 connected to suction means such as a vacuum pump (not shown). The water supply connector 79 is connected to a water pipe 112 provided with an on-off valve 110 and a pressure gage 111. With the suction mouthpiece 86 opposed to slag 115 on molten metal 114 in a laddle 113 at a predetermined level above said slag, suction is started, whereupon air (vapor) and slag are sucked into the mouthpiece 86 and the sleeve 82 which follows it. At this time, the cooling water under pressure supplied from the water supply pipe 112 fills the jacket 75 and, while cooling the inner pipe 71 and sleeve 82, flows into the mouthpiece 86 from the orifices 84 through the holes 85. As a result, the slag sucked into the mouthpiece 86 contacts the water and is thereby cooled and momentarily pelletized, the pellets then passing through the pipe bend 80 and flexible pipe 107 into the separator hopper 108, where they fall under their own weight and collect.

Standard data for the apparatus of the invention described above are as follows: The rate of supply of water is 0.04–0.5 l/sec; the supply water pressure is about 1.5kg/cm$^2$ for 0.2 l/sec; water flows from orifices 84 of 1.4–3mm (preferably about 2.5mm); the rate of suction flow in the mouthpiece 86 and sleeve 82 is about 20–60m/sec; and the particle size of pellets of slag formed by the action of water jets is about 3–30mm.

If said static pressure tube 104 is provided, it can be utilized for automatically controlling the level of the mouthpiece 86. When connected to air supply means (not shown) to blow air at a constant pressure from the nozzle 105, the static pressure in the static pressure tube 104 changes with the distance between the nozzle 105 and the slag 115 on the molten metal 114, i.e., the level of the suction mouthpiece 86 above the molten metal. This static pressure may be detected through the detection pipe 106. For example, one end of a U-tube 116 containing a liquid such as mercury may be connected to said detection tube to produce a head of said liquid corresponding to said static pressure, and a switch 117 may be used which opens or closes in response to the magnitude of such liquid head, said switch automatically controlling a motor 118 for driving a rack and pinion mechanism or a screw jack mechanism so that the suction mouthpiece 86 is automatically maintained at the predetermined level.

Figure 16:
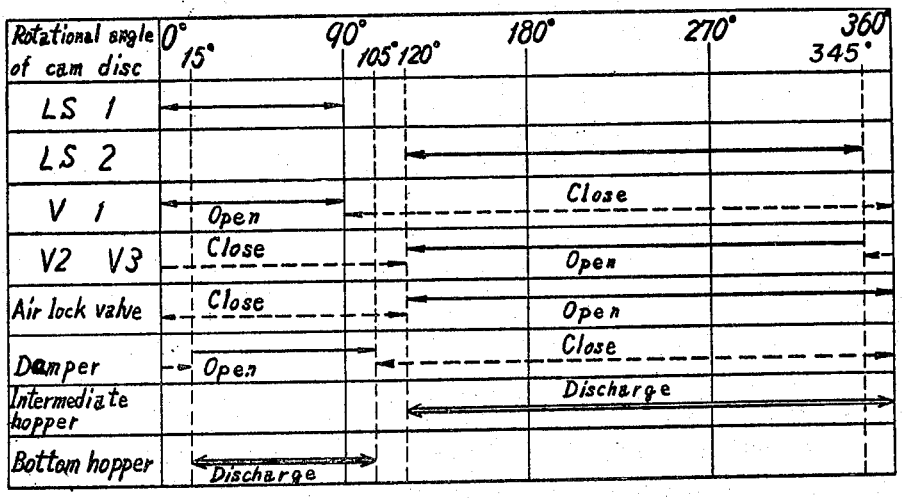
FIG. 16 is a time chart indicating the phases of operation of the various parts of the separating means.

Another embodiment of the separator means for separating sucked slag will now be described with reference to FIGS. 14 through 16.

Figure 14:
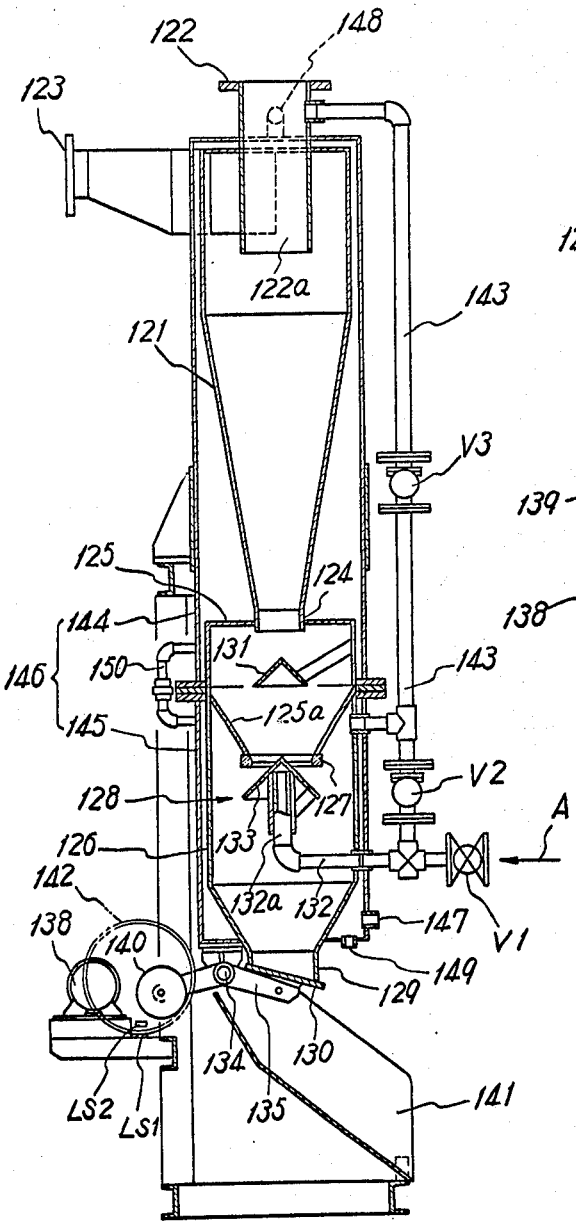
FIG. 14 is a sectional elevation showing another embodiment of the separating means.
Figure 15:
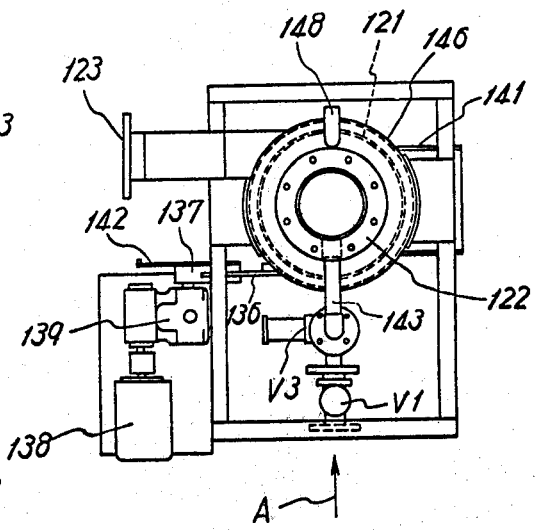
FIG. 15 is a plan view of the same.

In FIGS. 14 and 15, the character 121 designates a separator hopper, and disposed in the upper central region thereof is the inlet opening 122*a* of an exhaust connector pipe 122. A suction pipe connector 123 is tangentially connected to the peripheral wall of the hopper laterally of said opening 122*a*. If, therefore, an exhaust pipe connected to a vacuum pump or the like is connected to the pipe 122 and air is sucked, a negative pressure is produced in the separator hopper 121 and the slag and water sucked in through the suction pipe connector 123 are separated from the mixed gas of air and vapor by cyclone effect and fall downwardly of the separator hopper 121. The separator hopper 121 has a lower end opening 124 having connected thereto an intermediate hopper 125 to which a bottom hopper 126 is connected, thus providing a three-chamber arrangement. Disposed below the discharge port 127 of said intermediate hopper 125 is an air lock valve 128 adapted to be moved up and down by air pressure to close and open said discharge port 127, while at the discharge port 129 of the bottom hopper 126 there is disposed a damper valve 130 for opening and closing said discharge port 129, said air lock valve 128 and damper valve 130 being adapted to be opened and closed alternately with each other or in a "seesaw" fashion, as will be later described. The intermediate hopper 125, which makes perfect the separating effect by allowing the slag to be quickly discharged from the separator hopper 121, serves to temporarily retain the slag which has fallen. Within the intermediate hopper 125, there is a baffle plate 131 disposed immediately below the lower end opening 124 in the separator hopper to prevent the reverse flow of the slag. The air lock valve 128 comprises an umbrella-like valve body 133 fitted for vertical movement over the upright portion 132*a* of an air supply pipe 132 inserted in the bottom hopper 126, the arrangement being such that when an automatic valve V1 is opened to admit air under pressure in the direction of arrow A, the valve body 133 is pressed against a valve seat in the discharge port 127, thereby sealing the intermediate hopper 125 and separator hopper 121. The damper valve 130 is connected through a link 135 to a rotary shaft 134 supported laterally of the discharge port 129, and by rotating the shaft by suitable means, the discharge port 129 is opened and closed. In this embodiment, the outer end of a cam lever 136 extending from the rotary shaft 134 as shown in FIG. 15 abuts against a cam 137, and by rotating the cam 137 by a motor 138 through a speed reduction mechanism 139, the damper valve 130 is vertically swung around the axis of the rotary shaft 134, but any other suitable means using air pressure or the like may be employed to carry out such opening and closing operation. The character 140 designates a balance weight and 141 designates a discharge chute.

The opening and closing operation and mechanism of the air lock valve 128 and damper valve 130 will now be described. A cam disc 142 is attached to the cam 137 and there are provided limit switches LS1 and LS2 adapted to be separately actuated as the cam disc 142 is rotated, the limit switch LS1 being connected to the automatic valve V1 and the limit switch LS2 being connected to automatic valves V2 and V3. The automatic valves V2 and V3 are placed in a balance pipe 143 which connects the air pressure supply pipe 132 and bottom hopper 126 to the connector pipe 122. The balance pipe 143 assists the valve body 133 in falling under its own weight when the supply of air pressure to the air lock valve 128 is interrupted, and maintains the valve body 133 in its open position. Further, the balance pipe serves to equalize the pressures in the separator hopper 121, in the intermediate hopper 125 and in the bottom hopper 126. The opening and closing cycle effectged by such mechanism will now be described with reference to FIG. 16. While the cam disc 142 and cam 137 each makes one complete revolution, with the air lock valve 128 closed the damper valve 130 is opened to discharge the slag from the bottom hopper 126, whereupon the damper valve 130 is closed and the air lock valve 128 is opened to discharge the slag from the intermediate hopper 125 into the bottom hopper 126. That is, during the time the cam disc 142 is rotated through a constant angle (90° in the embodiment shown) from the reference angular position, the limit switch LS1 is maintained in its operative position to maintain the automatic valve V1 in its open position so that the air lock valve 128 is positively maintained in its closed psotion, the latter position being maintained until the disc cam is rotated through 120°. On the other hand, the damper valve 130 is maintained in its open position by the cam 137 while the latter is being rotated from its 15° position to its 105° position. During the rotation of the cam between 120° and 265°, the limit switch LS2 is maintained in its operative position to maintain the automatic valves LS2 and lS3 in their open position so that the air lock valve 128 is positively maintained in its open position, the latter position being maintained until the cam is rotated through 360°. At this time, the damper valve 130 is maintained in its closed position for the rotational angle of the cam from 105° to 15°. Therefore, when the damper valve is in its opened region from 15° to 105°, the slag is discharged from the bottom hopper 126 to the outside of the system and when the air lock valve 128 is in its opened region from 120° to 360°, l the slag is discharged from the intermediate hopper 125 into the bottom hopper 126. Thus, it will now be seen that since both the air lock valve 128 and the damper valve 130 are not opened at the same time, the slag can be discharged while maintaining the vacuum in the separator hopper.

In this embodiment, the slag being sucked is in thhe form of pellets of molten slag and in view of the fact that these slag pellets are still at a relatively high temperature while they pass through the separator hopper 121 and stay in the intermediate and bottomm hoppers 125 and 126, there is provided a cooling water jacket 146 defined by upper and lower outer sleeves 144 and 145, and water is supplied thereto through a water supply port 147 and discharged through a water discharge port 148. The character 149 designates a drain port and 150 designates a communication pipe which establishes communication between said upper and lower outer sleeves 144 and 145.

Although the air lock valve 128 is subjected to relatively high temperatures, since it is operated by air pressure, it will be cooled by that air. The air lock valve may, of course, be actuated by other means than air pressure. Further, the air lock valve 128, the damper valve 130 and the lower portion 125*a* of the intermediate hopper 125 which might be damaged by heat, are constructed so that they can be replaced.

We claim:

1. Apparatus for removing slag from the surface of a molten metal, comprising:

a suction pipe having an inlet end adapted to be positioned above said surface so as to draw the slag therefrom;

means for supplying water to the interior of said suction pipe adjacent to the inlet end thereof to pelletize entering slag;

a separator hopper communicating with said suction pipe, said separator hopper having a slag discharge port and first valve means for opening and closing said discharge port;

exhaust means for evacuating said separator hopper and applying suction to said suction pipe;

an auxiliary hopper mounted in sealed relation to said separator hopper so as to receive slag from said discharge port, said auxiliary hopper having a slag discharge port and second valve means for opening and closing the same;

and control means for operating said first and second valve means alternately, said control means acting to open the discharge port of the separator hopper when the discharge port of the auxiliary hopper is closed and vice versa whereby slag can be continuously drawn into said separator hopper and intermittently discharged from said auxiliary hopper.

2. Slag removal apparatus according to claim 1 further comprising a water cooling jacket provided around said suction pipe at least adjacent to said inlet end.

3. Slag removal apparatus according to claim 2 wherein said means for supplying water to the interior of said suction pipe includes means for permitting the flow of water from said cooling jacket to the interior of said suction pipe.

4. Slag removal apparatus according to claim 3 wherein said means for permitting the flow of water from said cooling jacket includes a plurality of circumferentially spaced orifices in said cooling jacket.

5. Slag removal apparatus according to claim 4 wherein a suction mouthpiece is connected to said inlet end of the suction pipe, and said means for permitting the flow of water from said cooling jacket includes an annular passage defined between said inlet end and said suction mouthpiece, said annular passage communicating with said orifices.

6. Slag removal apparatus according to claim 1 further comprising a water cooling jacket provided externally of said separator and auxiliary hoppers.

7. Slag removal apparatus according to claim 6 further comprising means for water cooling at least said first valve means.

8. Slag removal apparatus according to claim 1 wherein said valve means of said separator and auxiliary hoppers each include a valve member biased to closed position, and said control means comprises a driven rotary cam and two cam followers associated with said cam to move said valve members to their open positions.

9. Slag removal apparatus according to claim 1 wherein said separator hopper comprises a downwardly converging hopper discharging to an an intermediate hopper which forms an enlarged slag storage chamber, said first valve means and discharge port being provided in said intermediate hopper.

10. Slag removal apparatus according to claim 1 further comprising means for pneumatically closing said first valve means.

11. Slag removal apparatus according to claim 10 wherein said pneumatic closing means includes a pipe for supplying pressurized air to said first valve means, a connection from said pipe to suction from said exhaust means, and said control means includes valve means for selectively changing said pipe between pressurized air and suction.

12. A suction head for the removal of slag from the surface of a molten metal, comprising a suction pipe having a slag inlet end, a water cooling jacket provided around the outer periphery of the suction pipe at least adjacent to said inlet end, and a plurality of circumferentially spaced orifices for the flow of water from said cooling jacket to said inlet end.

13. A suction head according to claim 12 further comprising a suction mouthpiece removably mounted on said inlet end of the suction pipe.

14. A suction head according to claim 13 wherein said suction mouthpiece is provided with a surface adapted to deflect water received from said orifices toward the center of said suction pipe.

15. A suction head according to claim 13 wherein said inlet end of the suction pipe includes a portion projecting beyond said cooling jacket, said suction mouthpiece having an engagement portion adapted to be fitted over said projecting portion of the suction pipe, the suction pipe being proviided with locking projections adapted to be fitted in slots formed in said engagement portion, the outer peripheral surface of said engagement portion and the outer sides of said locking projections being provided with grooves adapted to form a continuous circumferential groove when said engagement portion is fitted over said projecting portion of the suction pipe with said locking projections fitted in said slots, and a ring engageable in said continuous groove for holding said suction mouthpiece in position.

16. A suction head according to claim 12 wherein a protective sleeve is removably fitted in said suction pipe.

17. A suction head according to claim 12 further comprising a static pressure tube arranged in side by side relation with the suction pipe and having an air nozzle which opens in the same direction as said inlet end, and a detection pipe connected to said pressure tube at a location adjacent to said air nozzle.

* * * * *